United States Patent [19]

Delgado

[11] 4,447,997

[45] May 15, 1984

[54] DRILLING RIG

[75] Inventor: Raúl A. Delgado, Queretaro, Mexico

[73] Assignee: Industria del Hierro, S.A., Queretaro, Mexico

[21] Appl. No.: 394,611

[22] Filed: Jul. 2, 1982

[51] Int. Cl.[3] ..... E04H 12/34

[52] U.S. Cl. ..... 52/120; 52/126.1; 52/127.2; 60/581

[58] Field of Search ..... 52/115, 116, 119, 120, 52/127.1, 127.2, 126.1; 60/580, 581

[56] References Cited

U.S. PATENT DOCUMENTS

| | | | |
|---|---|---|---|
| 2,429,009 | 10/1947 | Woolslayer | 52/116 |
| 2,499,563 | 5/1950 | Bill | 60/580 |
| 3,032,147 | 5/1962 | Wilkinson | 52/120 |
| 3,262,237 | 7/1966 | Jenkins | 52/116 |
| 3,995,701 | 12/1976 | Kelly | 52/116 |
| 4,351,153 | 9/1982 | Kosmala | 60/581 |

FOREIGN PATENT DOCUMENTS

| | | | |
|---|---|---|---|
| 465554 | 5/1950 | Canada | 52/120 |
| 857033 | 12/1952 | Fed. Rep. of Germany | 52/115 |
| 708327 | 5/1954 | United Kingdom | 52/116 |

*Primary Examiner*—Henry E. Raduazo

*Attorney, Agent, or Firm*—Quaintance & Murphy

[57] ABSTRACT

A drilling rig comprising a base; and an A-frame carried by the base. The A-frame has left and right hydraulic mast cylinders with pistons in the cylinders. The rig also has a mast pivoted on the base and capable of being raised from a horizontal position to a vertical position. The mast has left and right pads adapted to respectively contact the left and right mast pistons before the center of gravity of the mast passes a point directly above the axis of rotation of the mast. The rig also has drawworks adapted to raise the mast about its axis of rotation; and has a hydraulic control system comprising means for synchronizing the movement of the left mast piston with the right mast piston.

7 Claims, 6 Drawing Figures

DRILLING RIG

Drilling rigs in general and portable drilling rigs in particular are well-known in the art. These drilling rigs commonly comprise a base, an A-frame, a mast pivoted on the base and drawworks adapted to raise the mast. The components of the drilling rig are normally transported unassembled to the desired location. The mast is then assembled in its horizontal position and then is raised to its vertical position by the drawworks. To disassemble the rig, the first step is normally the lowering of the mast from the vertical position to the horizontal position. These drilling rigs are very large having a height, when assembled, of approximately fifty meters. They are also very heavy. The mast alone can weigh 70,000 kilograms. Because of the great weight and the great height, there are a great number of difficulties encountered in the prior art method of raising and lowering the mast. These problems are best illustrated by reference to FIGS. 1 and 2 of the drawings as filed which are representative of the prior art and are not representative of the present invention.

Figure 1:
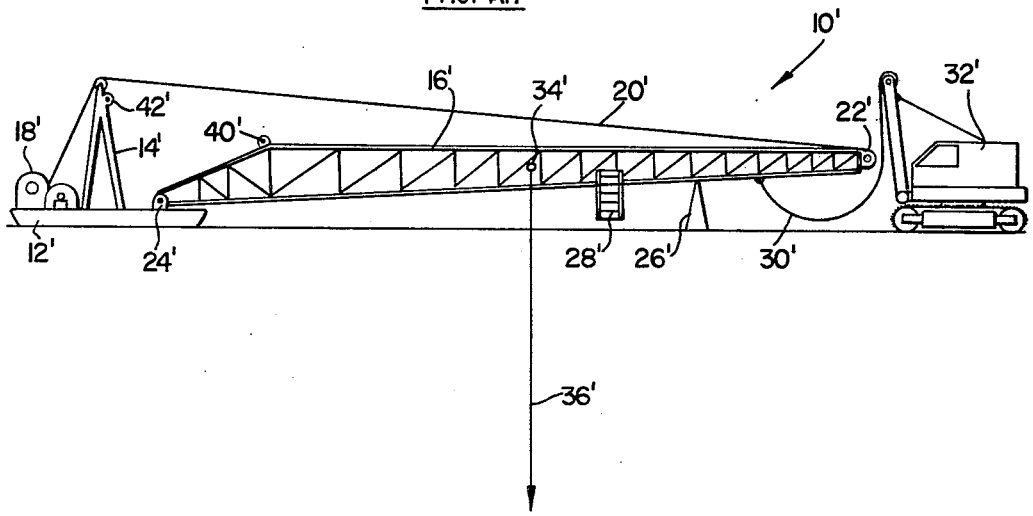
Fig. 1 Prior Art

Referring now to FIG. 1, there is shown a drilling rig 10' comprising a base 12', an A-frame 14', a mast 16' and drawworks 18'. A mast cable 20' is attached to the drawworks 18' and goes to the top 22' of the mast 16'. The mast 16' is connected to the base 12' by means of a pin 24' which constitutes its axis of rotation. The top 22' of the mast 16' is supported by a support 26' in a manner such that the platform 28' does not contact the ground. Attached to the mast 16' near its top 22' is a cable 30' the other end of which is attached to a crane 32', the function of which is described below. The mast 16' has a center of gravity 34' whose force and direction can be characterized by the arrow 36'.

Figure 2:
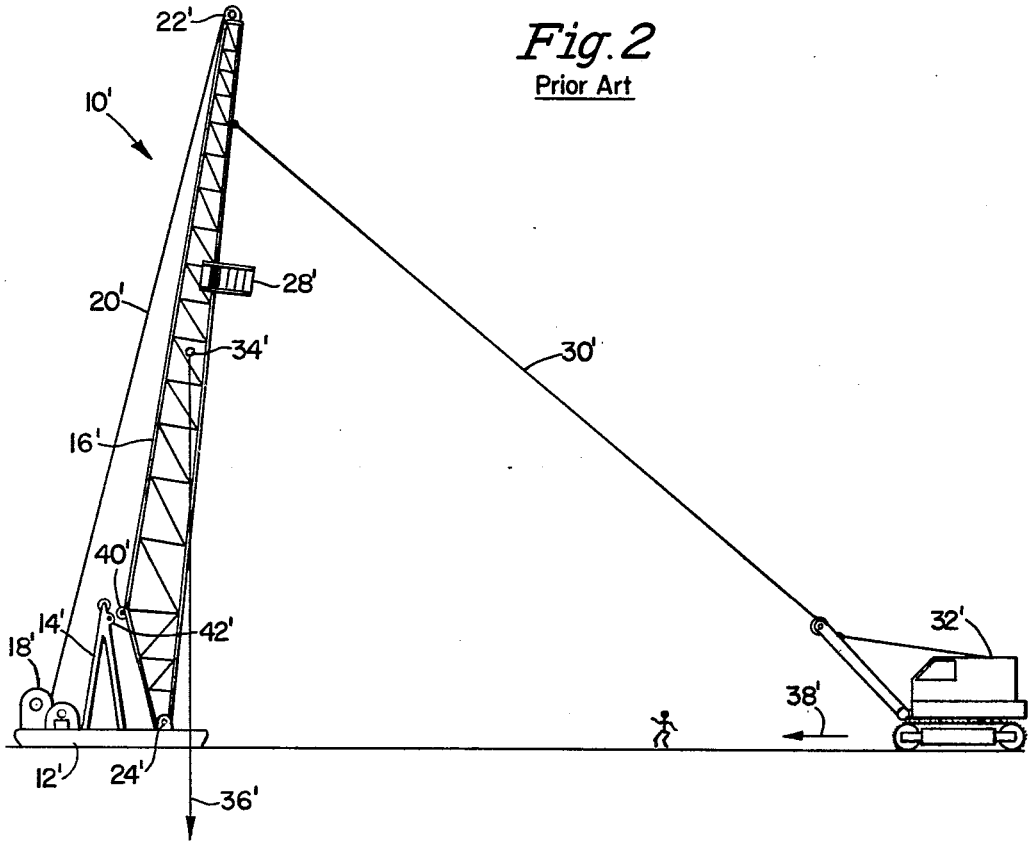
Fig. 2 Prior Art

In order to raise the mast from its horizontal position as shown in FIG. 1 to a vertical position, the operator (not shown) of the drawworks 18' causes the drum (not shown) of the drawworks 18' to rotate, shortening the mast cable 20'. At this time, the operator (not shown) of the crane 32' keeps slack in the crane cable 30'. The mast 16' continues to rotate about its axis of rotation represented by the pin 24' until a critical position is reached. That critical position is shown in FIG. 2. In the critical position, the center of gravity 34' is just on the side of the pin 24' away from the drawworks 18' as shown by the arrow 36'. At this critical point, the drawworks operator through skill, training, and experience must signal to the crane operator. At this time, the crane operator must remove the slack from the crane cable 30'. This is the first source of problems. The signal can be given by hand, by voice, or by radio. However, the signal may not be understood or may not be properly and adequately responded to. The crane operator has several methods for removing slack from the crane cable 30'. One method is to maintain partial brake tension on the crane cable 30' while the drawworks operator takes in on the mast cable 20', however, this causes several problems. If excessive stress is placed on the crane cable 30', the crane cable can break causing it to whip at high speeds, endangering nearby personnel. Alternatively, the crane 32' may be so light and the stress of the crane cable 30' so great that the entire crane 32' can be moved in the direction of the arrow 38'.

If the crane cable 30' breaks or if the crane 32' moves in the direction of the arrow 38', then the mast 16' can move toward the drawwork 18'. Because the crane 16' can weigh as much as 70,000 kilograms and because the A-frame 14' is engineered only for static loads, it is possible that the mast 16' will crush or bend the A-frame 14' rendering the drilling rig useless and endangering nearby personnel. If the mast 16' is properly raised and if the eye 40' lines up with the eye 42', a mast pin (not shown) can be passed through the eyes 40', 42', holding the mast 16' in its vertical position.

Similar but different problems occur when the vertical mast is to be lowered. The first step in lowering the mast is to remove the mast pin. However, for reasons which appear more completely below, this is a delicate and dangerous operation. The mast pin is approximately 10 meters above the king pin 24' whereas the top 22' of the mast 16' is approximately 50 meters above the ground. If the cable 20' is maintained under tension, then the mast pin is squeezed between the eye 40' and the eye 42', making it difficult or impossible to remove the mast pin. On the other hand if the cable 20' is slacked followed by removal of the mast pin, then the mast 16' may rotate about the king pin 24' until all slack is removed from the cable 20'. In attempts to solve this problem, it is common practice to attach a crane cable 30' near the top 22' of the mast 16' and to attempt to adjust tension in the mast cable 20' and the crane cable 30' to relieve pressure on the eyes 40', 42', such that the mast pin can be removed. This operation requires, however, complicated communication and coordination between the operator of the drawworks 18' and the operator of the crane 32'.

Accordingly, it is an object of the present invention to provide an improved drilling rig substantially free of one or more of the disadvantages of prior drilling rigs.

Another object is to provide an improved drilling rig having a mast which can be safely and effectively raised and lowered without the aid of a crane.

Still another object of the present invention is to provide an improved drilling rig that can be raised and lowered by the drawworks operator alone without communication with anyone else.

Yet another object of the present invention is to provide an improved drilling rig wherein the mast pin can be easily and safely removed without danger of the mast falling.

Figure 3:
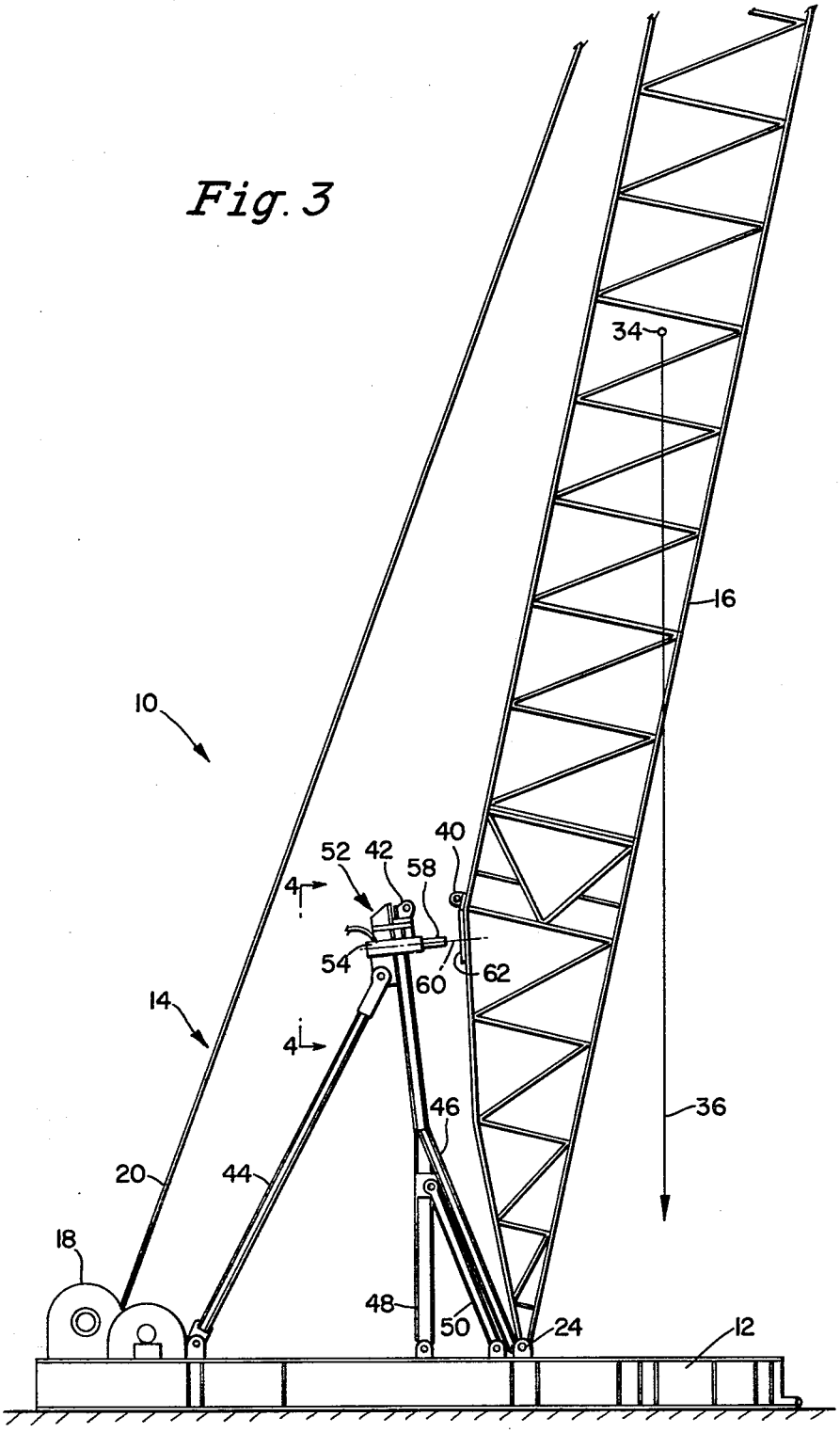
Figure 4:
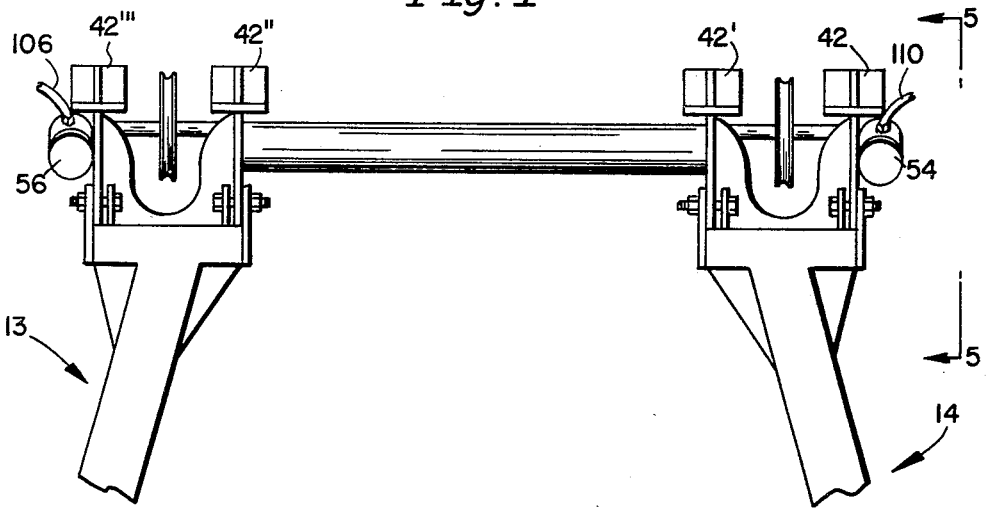
Figure 5:
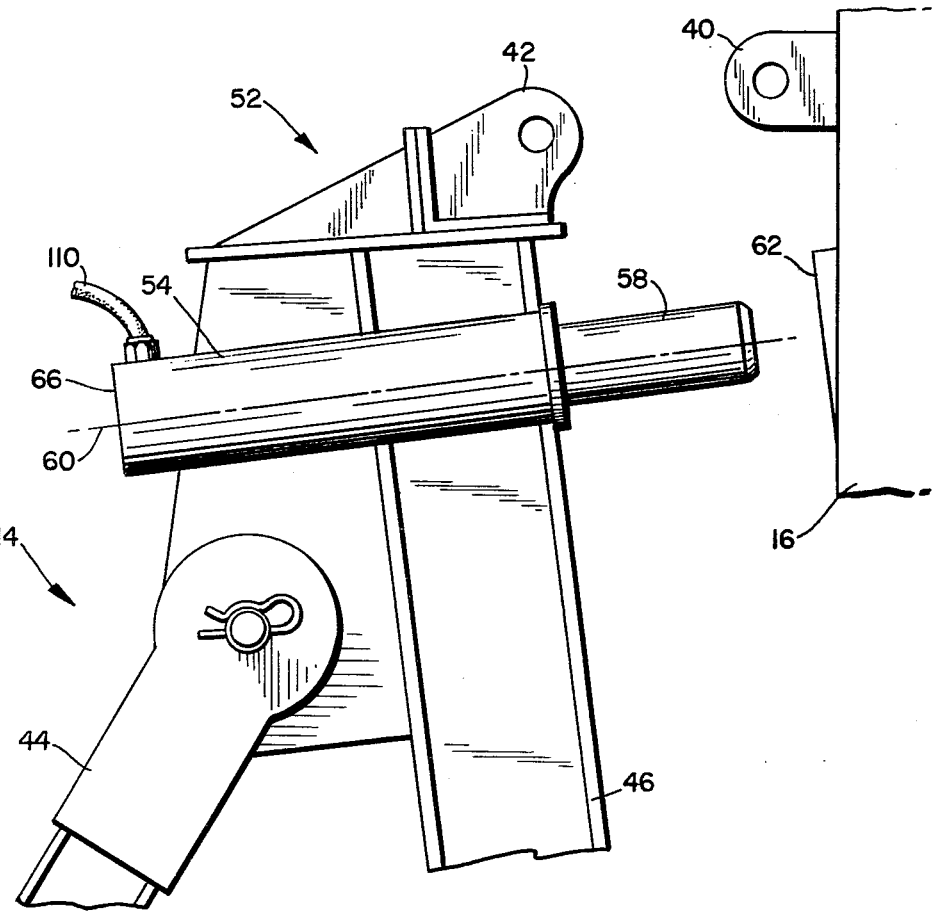
Figure 6:
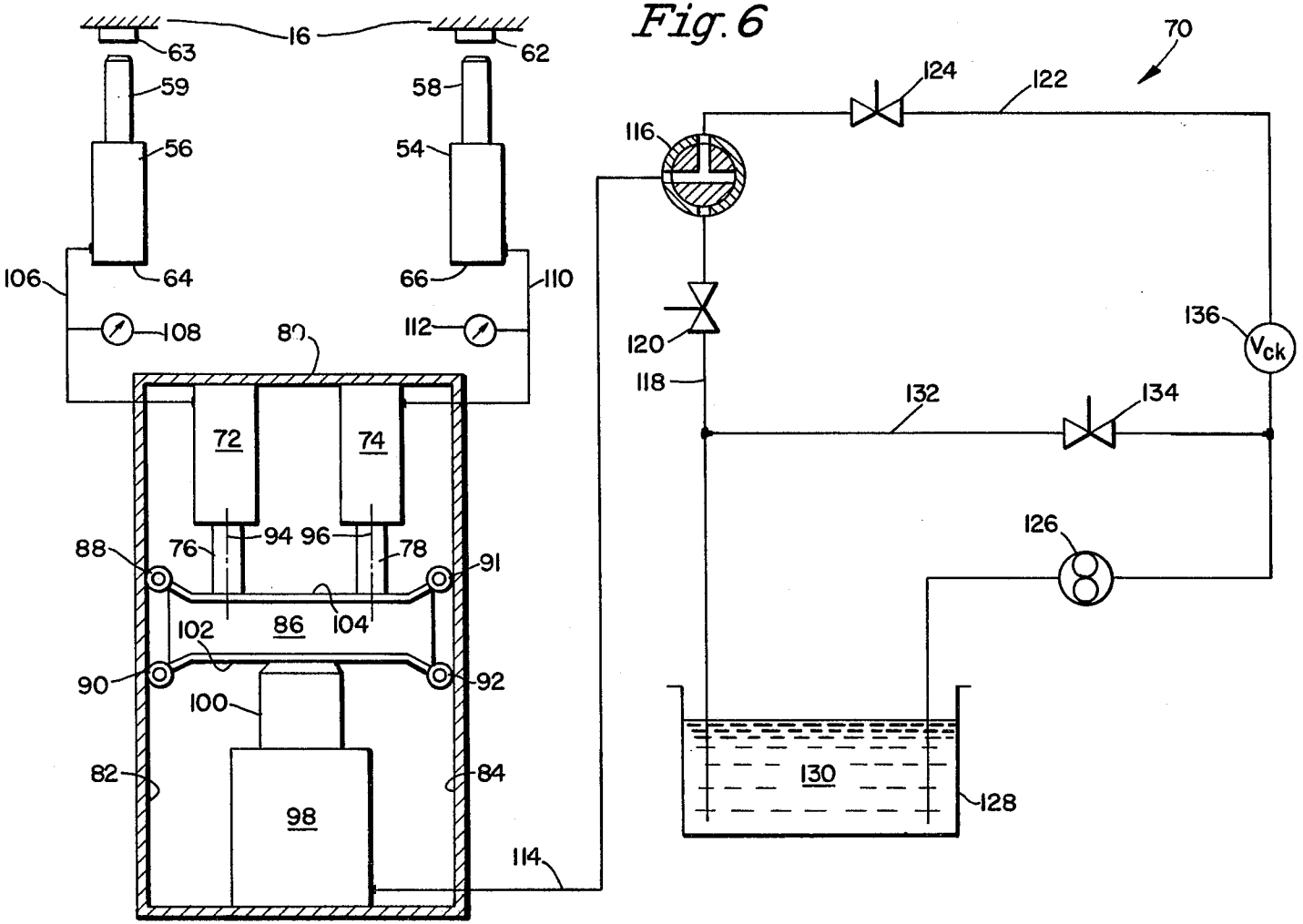

Additional objects and advantages of the present invention will be apparent to those skilled in the art by reference to the following detailed description and drawings wherein:

FIG. 1 is an elevation view of a prior art drilling rig with its mast in the horizontal position; and FIG. 2 is a horizontal view of the prior art drilling rig of FIG. 1 with the mast almost at the vertical position; and FIG. 3 is an elevation view of the drilling rig of the present invention; and FIG. 4 an end view taken along Line 4—4 of FIG. 3 on a different scale; and FIG. 5 is a view, on an enlarged scale of the apex of the A-frame which view is taken along Line 5—5 of FIG. 4; and FIG. 6 is a schematic representation of the hydraulic control system of the present invention.

In accordance with the present invention, there is provided an improved drilling rig comprising a base and an A-frame carried by the base. The A-frame has left and right hydraulic mast cylinders and associated pistons. The mast is pivoted on the base and is capable of being raised from a horizontal position to a vertical position. When the mast is in the vertical position, it has a center of gravity far above the top of the A-frame. The mast carries left and right pads adapted to respectively contact the left and right mast pistons before the center of gravity of the mast passes a point directly above the axis of rotation of the mast. The drilling rig also has drawworks adapted to raise the mast about its axis of rotation. The drilling rig of the present invention is provided with a hydraulic control system which has means for synchronizing the movement of the left mast piston with the right mast piston.

Referring now to the drawings in general and in particular to FIG. 3, there is shown a drilling rig 10 of the present invention. The drilling rig 10 comprises a base 12 and an A-frame 14 carried by the base. The base 12 also carries drawworks 18 attached to a cable 20. The mast 16 rotates about a right king pin 24. The other leg of a mast rotates about a left king pin (not shown). The mast 16 carries an eye 40 whereas the A-frame 14 carries an eye 42.

The A-frame 14 has multiple legs such as the legs 44, 46, 48, and 50. The bottoms of the legs 44, 46, 48, 50 are fixably pinned to the base 12. The apex 52 of the A-frame 14 is at its top. In this connection, it should be noted that A-frame is a common designation even though there is no cross-member which, if present, would make the A-frame 14 look more like the letter "A". Others skilled in the art sometimes refer to the A-frame as a gin pole. As shown in FIG. 4, there are actually two A-frames such as the left A-frame 13 and the right A-frame 14. The A-frame 14 carries a right mast cylinder 54. The left A-frame 13 carries a left mast cylinder 56. Slidably mounted within the right mast cylinder 54 is the right mast piston 58. The axis 60 of the right mast piston 54 is aligned substantially coincidentally with a chord of a circle, the center of which is the axis of rotation of the mast 14. This axis of rotation is represented by the king pin 24. The left mast piston 56 has a similar structure.

The mast 16 is as tall as those of the prior art, typically 50 meters. The mast 16 is pivoted at two points on the base. The one point is the king pin 24. The other point is a king pin (not shown) spaced laterally away from the king pin 24 but having an axis of rotation coincidental with the axis of rotation of the king pin 24. The center of gravity of the mast 16 is not shown because of the necessary scale of FIG. 3. However, the center of gravity of the mast 16 is substantially identical to the center of gravity 34' of the mast 16'. The center of gravity of the mast 16 is above the ground by a distance at least equal to twice the distance that the apex 52 of the A-frame 14 is above the ground. The mast 16 carries a right pad 62 adapted to contact the right mast piston 58 before the center of gravity of the mast 14 passes a point directly above the axis of rotation of the mast 16, which axis of rotation is represented by the king pin 24 and the other co-aligned king pin (not shown).

As shown in FIG. 4 there are actually four eyes 42', 42'' and 42''' as shown in FIG. 4. There are a corresponding number of eyes carried by the mast 16. If the mast 16 twists the problem of inserting the four pins in their four pair of eyes is further complicated. The present invention solves this problem.

The drawworks 18 are adapted to raise the mast 16 from the horizontal position to a vertical position by rotating the mast 16 about its axis of rotation.

Referring now to FIG. 6 there is shown the hydraulic control system 70 of the present invention. The hydraulic control system 70 constitutes means for synchronizing the movement of the right mast piston 58 with the left mast piston 59. When either the left mast piston 59 or the right mast piston 58 is caused to move in the direction of the bottoms 64, 66 of their respective mast cylinders 54, 56 then either of the mast pistons 58, 59 moves an amount substantially equal to the amount that the other mast piston moves. The hydraulic control system 70 further comprises a left leveling cylinder 72 and a right leveling cylinder 74. The left leveling cylinder 72 has a left leveling piston 76 whereas the right leveling cylinder 74 has a right leveling piston 78. The pistons 76, 78 are slidably mounted in their respective cylinders 72, 74. In the embodiment shown, the leveling cylinders 72, 74 and their respective pistons 76, 78 are contained within an enclosure 80 provided with parallel opposing walls 82, 84. The pistons 76, 78 rest on the first side of a stabilizing beam 86. The stabilizing beam 86 is fitted on one side with rollers 88, 90 adapted to contact the wall 82 and on the other side with rollers 91, 92 adapted to contact the wall 82. By means of this arrangement, movement of the leveling beam 86 is restricted to a direction parallel to the axes 94, 96 of the pistons 76, 78. Also within the enclosure 80 is a master cylinder 98 having slidably mounted therein a master piston 100. The master piston 100 contacts the side 102 of the leveling beam 86 opposite the side 104 which is in contact with the pistons 76, 78. The left mast cylinder 56 is in fluid communication with the left mast cylinder line 106. Line 106 is fitted with a gauge 108 which can be remotely located near the eye of the operator of the drawworks 181. Similarly, the right mast cylinder 54 is in fluid communication with the right mast cylinder line 110 which, itself, is fitted with a gauge 112. The line 106 is in fluid communication with the leveling cylinder 72 whereas the line 110 is in fluid communication with the leveling cylinder 74. The master cylinder 98 is in fluid communication with the master cylinder hydraulic line 114 which in turn is in fluid communication with a three-way valve 116. Also in fluid communication with the three-way valve 116 is a dumping line 118. The dumping line 118 is provided with a contraction control valve 120 adapted to restrict the flow of hydraulic fluid through the dumping line 118. The three-way valve 116 is also in fluid communication with an expansion control line 122. In the manner shown, the three-way valve 116 can cause the line 114 to be in fluid communication with either the line 118 or the line 122 but not both at the same time. For this reason, the three-way valve 116 might be referred to as a directional valve. The expansion control line 122 is provided with an expansion control valve 124. The hydraulic control system 70 also has a pump 126 adapted to take suction from a hydraulic reservoir 128 and to deliver hydraulic fluid 130 from the reservoir 128 under pressure to the high pressure side of the expansion control valve 124. In order to accomplish this, the pump discharges to the line 122 but in the line 122 upstream of the expansion control valve 124 is a pump recirculating line 132 fitted with a relief valve 134. The relief valve 134 can be set to open at any desired pressure thus ensuring a supply of fluid 130 at any desired pressure to the high pressure side of the expansion control valve 124. In order to prevent back flow in the line 122 it is provided with a check valve 136.

By virtue of the above described structure the mast can be safely and effectively raised and lowered without the aid of a crane or other guy cables; and this can be accomplished by the drawworks operator alone without communication with anyone else. Furthermore the mast pin can be easily and safely removed without danger of the mast falling. In accordance with the present invention in order to raise the mast the left and right mast pistons, 58, 59 are caused to be extended. If they are not already in this position this can simply be accomplished by arranging the three-way valve 116 for fluid communication between the master cylinder line 114 and the expansion control line 122. The pump 126 is then started and the valve 124 periodically opened until the pistons 58, 59 are fully extended.

The three-way valve 116 is then arranged for fluid communication between the master cylinder line 114 and the dumping line 118. The contraction control valve 120 is adjusted to provide the desired flow of fluid 130 into the reservoir 128. The drawworks operator then causes the drum (not shown) of the drawworks 18 to turn taking in the mast cable 20 raising the mast 16. As the mast is raised the pad 62 contacts the piston 58 (see FIGS. 3 and 5) before the center of gravity 34 passes a point directly above the king pin 24 which constitutes the axis of rotation of the mast 16. The drawworks operator continues to take up on the cable 20 causing the pad 62 to press against the piston 58 compressing it. At a certain point the center of gravity 34 passes over the king pin 24 with the result that the piston 58 is now pushed toward the bottom 64 of the cylinder 54 by the combined effect of the weight of the mast 16 and the tension in the mast cable 20. Referring now to FIG. 6, as the piston 58 moves toward the bottom 66 of the cylinder 54, hydraulic fluid is caused to flow through the line 110 and into the leveling cylinder 74. This causes the leveling piston 78 to move outward causing movement of the stabilizing beam 86 in the direction of the master cylinder 98. This in turn compresses the master piston 100 into the master cylinder 98 causing flow of hydraulic fluid through the master cylinder line 114 past the directional valve 116 and into the dumping line 118. The contraction control valve 120 having been previously adjusted, the flow of hydraulic fluid through the dumping line 118 into the reservoir 128 is controlled such that the piston 58 moves into the cylinder 54 slowly and evenly thus easing the mast 16 and its eye 40 toward the eye 42. By opening and closing the contraction control valve 20 the hole in the eye 40 can be easily aligned with the hole in the eye 42 permitting insertion of the king pin. If the pad 63 simultaneously contacts the left mast piston 59 then a similar operation occurs. However, if either mast piston 58 or 59 contacts its respective pads 62, 63 prior to the time that the other mast piston contacts its pad then by virtue of prior setting of the contraction control valve 120 movement of the stabilizing beam 86 will be restricted prohibiting flow of hydraulic fluid through the line 106 or 110 whichever is first contacted until the other pad contacts the other mast cylinder. As can be seen from the above description the entire movement of mast 16 from a point prior to the time that the center of gravity 34 passes the axis of rotation 24 until insertion of the king pin is controlled by the hydraulic system 70 that can be operated by the drawworks operator. No crane 32' is required. No communication with anyone else is required. The danger of a broken crane cable 30' is avoided because there is no crane cable 30'. The mast 16 will not damage the A-frame 14 because the mast 16 is hydraulically eased into its final position when the mast pins are inserted.

In accordance with the present invention the lowering of the mast 16 is also greatly facilitated. To lower the mast 16 the drawworks operator places an appropriate amount of tension in the mast cable 20. He then arranges the three-way valve 116 for fluid communication between the expansion control line 122 and the master cylinder line 144. The pump 126 is then started and the expansion control valve 124 opened and then closed to cause either or both of the mast pistons 58, 59 to move an amount just sufficient to free each of the four mast pins which are in the eyes 42, 42', 42'', 42''' (see FIG. 4) and the associated eyes such as the eye 40 carried by the mast 16. After all four mast pins have been removed the expansion control valve 124 is again opened causing the mast cylinders 58, 59 to slowly and evenly extend, pushing on their respective pads 62, 63 rotating the mast 16 about its axis of rotation represented by the king pin 24 (see FIG. 3). The location of the cylinders 54, 56 and the length of the pistons 58, 59 is such that the pistons 58, 59 rotate the mast 16 until the center of gravity 34 of the mast 16 passes over the king pin 24 at which time gravity alone places tension in the mast cable 20 permitting the drawworks operator to easily lower the mast 16 by appropriate operation of the brake (not shown) which is operably connected to the drum (not shown) of the drawworks 18. Thus it can be seen that on lowering of the mast 16 no crane 32' is required. Nor is any crane cable 30' required. Nor is any communication required with anyone else. The drawworks operator can accomplish the entire operation swiftly, easily and safely without communication or coordination with anyone else. This is particularly important since the eye 42 is approximately 10 meters above the ground. Any violent movement of the A-frame 14 can dislodge the rig operator causing serious injury.

Although the invention has been described in considerable detail, our reference to a preferred embodiment thereof, it will be understood that modifications can be made within the spirit and scope of the invention as described above and as claimed below.

What is claimed is:

1. A drilling rig comprising:

I a base; and

II an A-frame carried by the base;

A. left and right hydraulic mast cylinders attached to the A-frame;

B. left and right mast pistons in the left and right mast cylinders; and

III a mast pivoted on the base and capable of being raised from a horizontal position to a vertical position; and when in the vertical position having a center of gravity far above the top of the A-frame; said mast carrying left and right pads adapted to respectively contact the left and right mast pistons before the center of gravity of the mast passes a point directly above the axis of rotation of the mast; and IV drawworks adapted to raise the mast about its axis of rotation; and V a hydraulic control system comprising means for synchronizing the movement of the left mast piston with the right mast piston.

2. The drilling rig of claim 1 wherein the axis of the left mast piston is arranged substantially coincidentally with a chord about the axis of rotation of the mast and wherein the axis of the right mast piston is arranged substantially coincidentally with a chord about the axis of rotation of the mast.

3. The drilling rig of claim 1 wherein:

the left mast cylinder is in fluid communication with a left leveling cylinder; and the right mast cylinder is in fluid communication with a right leveling cylinder; and a left leveling piston is slidably mounted in the left leveling cylinder; and a right leveling piston is slidably mounted in the right leveling cylinder; and wherein both the left and the right leveling pistons rest against a stabilizing beam whose motion is restricted to a direction only parallel to the axes of the leveling pistons; and the opposite side of the stabilizing beam is in contact with a master piston positioned in a master cylinder; and the master cylinder has an outlet equipped with hydraulic flow restricting means.

4. The drilling rig of claim 1 wherein the hydraulic control system includes means for prohibiting the left mast piston from retracting into the left mast cylinder a distance that is no greater than the distance to which the right mast piston has retracted into the right mast cylinder.

5. The drilling rig of claim 1 wherein the hydraulic control system includes means for prohibiting the right mast piston from retracting into the right mast cylinder a distance that is no greater than the distance to which the left mast piston has retracted into the left mast cylinder.

6. The drilling rig of claim 1 further comprising means for causing equal volumes of hydraulic fluid to simultaneously flow into the left mast cylinder and the right mast cylinder.

7. A portable drilling rig capable of being assembled with its mast in the horizontal position and capable of having its mast elevated to its vertical position without the aid of a crane or other cables and capable of being similarly lowered from its vertical position to its horizontal position; said rig comprising:

I a base, the lower surface of which is adapted to contact the surface of the earth; and II an A-frame carried by the base, the legs of the A-frame being fixably attached to the base; the apex of the A-frame extending above the base;

A. A left hydraulic mast cylinder attached to the side of the left A-frame near the apex of the left A-frame; and B. a left piston slidably mounted in the left mast cylinder wherein the axis of the piston is aligned substantially coincidentally with a chord of a circle, the center of which is the axis of rotation of a mast; and C. a right piston slidably mounted in the right mast cylinder wherein the axis of the piston is aligned substantially coincidentally with a chord of a circle, the center of which is the axis of rotation of a mast; and III A tall mast, the lower end of which is pivoted at two points on the base which two points define an axis of rotation; said mast being capable of being raised from a horizontal position to a vertical position; and when in the vertical position having a center of gravity which is above the ground by a distance at least equal to twice the distance that the apex of the A-frame is above the ground; said mast carrying left and right pads adapted to respectively contact the left and right mast pistons before the center of gravity of the mast passes a point directly above the axis of rotation of the mast; and IV drawworks adapted to raise the mast from the horizontal position to a vertical position by rotating the mast about its axis of rotation; and V a hydraulic control system comprising means for synchronizing the movement of the left mast piston with the right mast piston such that when either the left mast piston or the right mast piston are caused to move in the direction of the bottom of their respective mast cylinders that either of the mast pistons moves an amount substantially equal to the amount that the other mast piston moves; said hydraulic control system comprising:

A. a left leveling cylinder in fluid communication with the left mast cylinder; and B. a right leveling cylinder in fluid communication with the right mast cylinder; and C. a left leveling piston slidably mounted in the left leveling cylinder; and D. a right leveling piston slidably mounted in the right leveling cylinder; and E. a leveling beam one surface of which is adapted to contact the left leveling piston and the right leveling piston and is perpendicular to the axes of each of these pistons; and F. means for restricting movement of the leveling beam to a direction parallel to the axes of the leveling pistons; and G. a master cylinder having a master piston slidably mounted therein wherein the master piston is adapted to contact the side of the leveling beam opposite the side contacted by the leveling pistons; and H. a master cylinder hydraulic line in fluid communication with the master cylinder; and I. a three-way directional valve in fluid communication with the master cylinder hydraulic line; and J. a dumping line in fluid communication with the directional valve; and K. a contraction control valve adapted to restrict the flow hydraulic fluid through the dumping line; and L. an expansion control line in fluid communication with the directional valve; and M. an expansion control valve operably connected to the expansion control line; and N. a pump adapted to take suction from a hydraulic reservoir and deliver hydraulic fluid under pressure to the high pressure side of the expansion control valve; and O. whereby when the mast is being raised when one of the pads contacts its mast piston before the other pad contacts its mast piston then the increased pressure in the mast cylinder first contacted increases, causing fluid to flow through the appropriate mast cylinder line into the leveling cylinder, thereby moving the stabilizing beam and causing the master piston to compress the fluid in the master cylinder further causing fluid to leave the master cylinder through the master cylinder line, through the directional valve, through the contraction control valve, through the dumping line into the reservoir which flow of fluid dampens the movement of the mast as it moves in the direction of the A-frame;

P. whereby upon arranging the directional valve to receive fluid from the expansion control line and upon causing the pump to operate, that opening of the expansion control valve causes fluid to flow through the master cylinder line into the master cylinder moving the stabilizing beam in the direction of the leveling cylinders simultaneously and evenly compressing the leveling pistons into the leveling cylinders thereby forcing fluid through the respective mast cylinder lines into the mast cylinders causing the mast pistons to evenly push against the mast pads thereby slowly moving the mast to a point until the center of gravity just passes a point directly above the axis of rotation of the mast thereby permitting the mast to be lowered by the drawworks, all without the necessity of employing a separate crane.

* * * * *